US006384794B1

(12) United States Patent
Huang

(10) Patent No.: US 6,384,794 B1
(45) Date of Patent: May 7, 2002

(54) SLOT ANTENNA ASSEMBLY HAVING AN ADJUSTABLE TUNING APPARATUS

(75) Inventor: Chien-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/954,109

(22) Filed: Sep. 12, 2001

(30) Foreign Application Priority Data

Aug. 3, 2001 (TW) ..... 90213256

(51) Int. Cl.[7] ..... H01Q 13/10
(52) U.S. Cl. ..... 343/767; 343/768
(58) Field of Search ..... 343/767, 768, 343/769, 770, 771, 746, 700 MS

(56) References Cited

U.S. PATENT DOCUMENTS 4,225,971 A * 9/1980 Shichijo et al. ..... 455/155
4,733,245 A * 3/1988 Mussler ..... 343/769
5,465,098 A * 11/1995 Fujiswaw ..... 343/718
5,589,840 A * 12/1996 Jujisawa ..... 343/718
6,150,989 A * 11/2000 Aubry ..... 343/767

* cited by examiner

*Primary Examiner*—Don Wong
*Assistant Examiner*—James Clinger
(74) *Attorney, Agent, or Firm*—Wei Te Chung

(57) ABSTRACT

A slot antenna assembly for an electronic device comprises a slot antenna body (1), an adjustable tuning apparatus (2) mounted to the slot antenna body and a coaxial feeder cable (3) electrically connected with the slot antenna body by the adjustable tuning apparatus. An inner core (31) of the coaxial cable feeds through a holding portion (21) of the adjustable tuning apparatus and contacts a second slide slot (13) in the slot antenna body, establishing a first feed point. A braiding layer (33) is soldered to a slide portion (23) of the adjustable tuning apparatus, which contacts the slot antenna body at a second feed point. The adjustable tuning apparatus slides along a slot (11) in the slot antenna body, changing the operating frequency band of the slot antenna assembly by changing the position of the feed points.

8 Claims, 3 Drawing Sheets

SLOT ANTENNA ASSEMBLY HAVING AN ADJUSTABLE TUNING APPARATUS

FIELD OF THE INVENTION

The present invention relates to a slot antenna assembly, and in particular to a slot antenna having an apparatus for conveniently adjusting the operating frequency band of the slot antenna.

BACKGROUND OF THE INVENTION

There is a growing need for slot antennas for use in wireless communication devices. A conventional slot antenna assembly, disclosed in U.S. Pat. No. 6,150,989, comprises a body made from a metal foil with an elongated, narrow slot defined therein, a cable having an inner core wire soldered to a flat surface at a first feed point near the slot and an outer shield soldered to the flat surface at a second feed point near the slot and opposite the first feed point, and diodes secured across the slot at a predetermined location. When the antenna is used in a transmission mode, at least one of the diodes can conduct, short-circuiting a portion of the slot and effectively reducing the length of the slot to a distance between the location of the diodes and the first and second feed points. The operating frequency band of the slot antenna can be changed by changing the location of the diodes.

However, changing the operating frequency band requires that the diodes be removed from the antenna and then soldered to another location crossing the slot. The procedure is inconvenient. Furthermore, such a change adjusts the operating frequency band of the slot antenna discretely, not continuously, so it is difficult to set an optimal operating frequency band of the slot antenna.

Hence, an improved antenna assembly is desired to overcome the above-mentioned shortcomings of existing antenna assemblies.

BRIEF SUMMARY OF THE INVENTION

A primary object, therefore, of the present invention is to provide an improved slot antenna assembly having an adjustable tuning apparatus for changing the operating frequency band of the antenna conveniently over a continuous range.

An antenna assembly in accordance with the present invention comprises a slot antenna body comprising a metal foil defining an elongated slot therein, an adjustable tuning apparatus movably mounted to the slot antenna body and a coaxial feeder cable. The adjustable tuning apparatus comprises a conductive holding portion, a conductive slide portion and an insulative connecting portion connecting the holding portion with the slide portion. The coaxial cable comprises an inner core wire which is electrically connected to the slot antenna body through the holding portion and an outer shield which is electrically connected to the slot antenna body by the slide portion.

The adjustable tuning apparatus can slide along the slot to change the operating frequency band of the antenna body.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
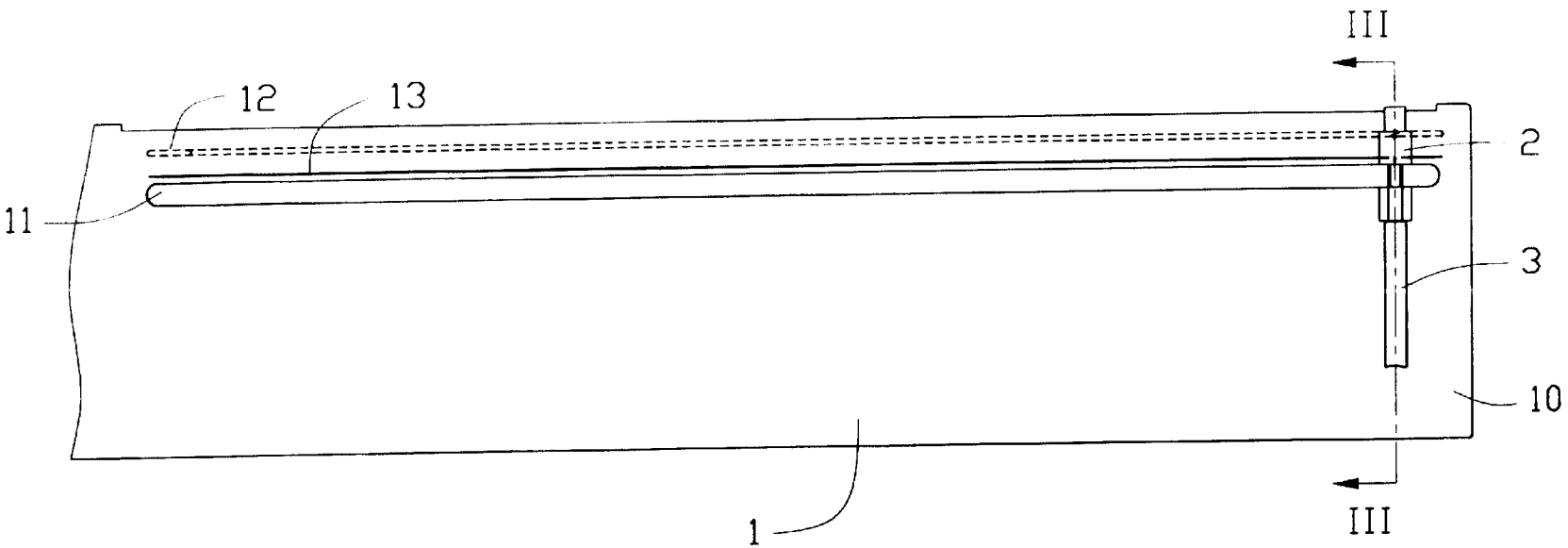
FIG. 1 is a top view of a slot antenna assembly in accordance with the present invention.

Referring to FIG. 1, a slot antenna assembly in accordance with the present invention comprises a slot antenna body 1, an adjustable tuning apparatus 2 slideably mounted to the slot antenna body 1 and a coaxial feeder cable 3 electrically connected with the slot antenna body by the adjustable tuning apparatus.

The slot antenna body 1 comprises a metal foil 10, an elongated, narrow slot 11 defined in the metal foil 10 to separate the metal foil to two conductive regions, a first slide slot 12 defined near and along the slot 11 in a first surface (not labelled) of the metal foil 10 and a second slide slot 13 defined near and along the slot 11 in a second surface (not labelled) of the metal foil 10, wherein each of the first and second slide slots 12, 13 is a shallow groove not penetrating the metal foil 10.

Figure 2:
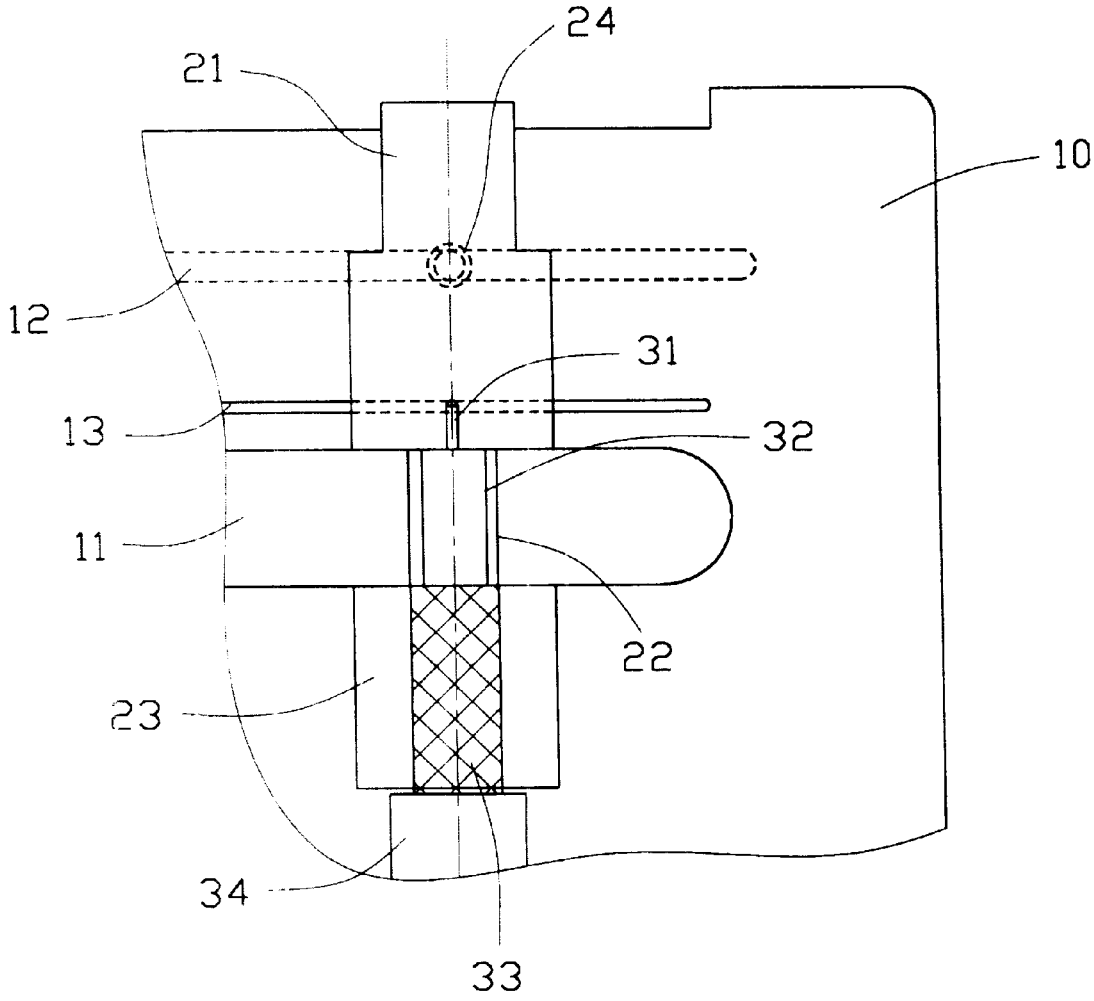
FIG. 2 is a top view of an adjustable tuning apparatus assembled to a slot antenna body of the slot antenna assembly of FIG. 1.
Figure 3:
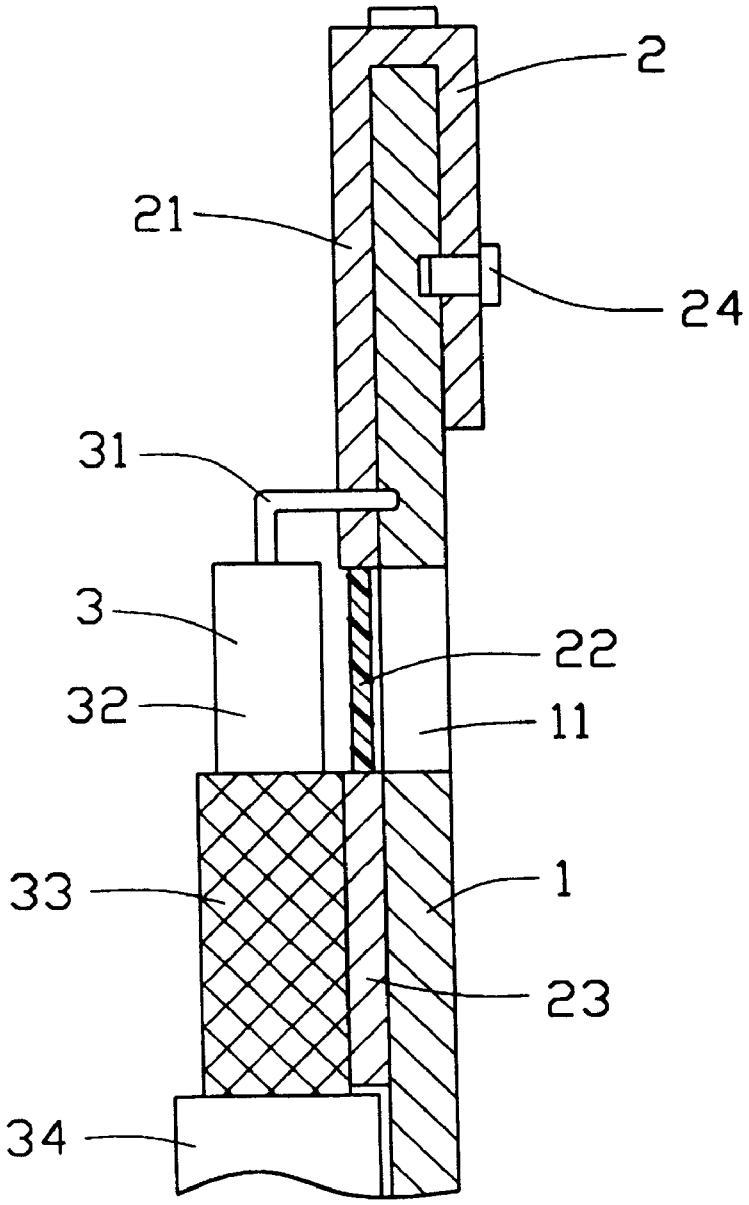
FIG. 3 shows a cross-sectional view of the slot antenna assembly of FIG. 1 taken along a dashdotted line III—III shown in FIG. 1.

Referring to FIGS. 2 and 3, the adjustable tuning apparatus 2 comprises a conductive holding portion 21, a conductive slide portion 23, a screw 24, and an insulative connecting portion 22 connecting the holding portion 21 with the slide portion 23. The holding portion is U-shaped and engages with the metal foil 10 at one side of the slot 11. At another side of the slot 11, the slide portion 23 is in contact with the metal foil 10 on the second surface at the metal foil 10. The screw 24 is screwed through a first arm (not labeled) of the holding portion 21, an end of the screw 24 being received in the first slide slot 12. The insulative connecting portion 22 connects the holding portion 21 with the slide portion 23 across the slot 11.

The coaxial feeder cable 3 comprises an inner core 31, a braiding layer 33, an inner insulator 32 separating the inner core 31 and the braiding layer 33, and an outer insulator 34 surrounding the braiding layer 33. The inner core 31 is held by a second arm (not labeled) of the holding portion 21. An end of the inner core 31 is extended through the second arm and is received in and engages with the second slide slot 13 of the metal foil. The braiding layer 33 is soldered to the slide portion 23.

It is noted that the inner core 31 and the braiding layer 33 are electrically connected with the metal foil 10. A first feed point is located where the inner core 31 contacts with the metal foil 10 and a second feed point is located where the slide portion 23 contacts with the metal foil 10. Therefore, a user can change the operating frequency band of the slot antenna by adjusting the location of the first and second feed points (not labelled), which are where the adjustable tuning apparatus 2 contacts the metal foil 10.

During use, the adjustable tuning apparatus 2 is moved along the slot until a desired Voltage Standing Wave Ratio (VSWR) is detected. The screw 24 is then tightened to fix the adjustable tuning apparatus 2 to the slot antenna body 1.

Compared with the prior art, the process of adjusting the frequency band of the slot antenna assembly of the present invention is convenient and the operating frequency band is continuously, not discretely, adjustable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna assembly for an electronic device, comprising:

a slot antenna body comprising a metal foil with an elongated slot defined therein;

an adjustable tuning apparatus movably mounted to the slot antenna body, comprising a conductive holding portion, a conductive slide portion and an insulative connecting portion connecting the holding portion with the slide portion; and a coaxial feeder cable, an inner core wire of the cable being electrically connected to the slot antenna body on one side of the slot through the holding portion, and an outer shield of the cable being electrically connected to the slot antenna body on an opposite side of the slot by the slide portion.

2. The antenna assembly as claimed in claim 1, wherein the holding portion is U-shaped and engages with the metal foil at one side of the slot, and the slide portion is in contact with the metal foil at another side of the slot, and the insulative connecting portion connects the holding portion with the slide portion across the slot.

3. The antenna assembly as claimed in claim 1, wherein a shallow first and second slide slots are defined in two surfaces of the metal foil, near and along the elongated slot.

4. The antenna assembly as claimed in claim 3, wherein the adjustable tuning apparatus further comprises a screw screwed through the holding portion and having an end received in the first slide slot.

5. The antenna assembly as claimed in claim 4, wherein the adjustable tuning apparatus can slide along the slot to change the operating frequency band of the slot antenna body when the screw is not tightened.

6. The antenna assembly as claimed in claim 3, wherein an end of the inner core wire is received in the second slide slot and engages with the metal foil through the holding portion, and the outer shield is soldered to the slide portion.

7. An antenna assembly for an electronic device, comprising:

a slot antenna body comprising a metal foil with an elongated slot defined therein;

an adjustable tuning apparatus mounted to the slot antenna body and comprising a conductive first portion, a conductive second portion, an insulative portion connecting the first portion with the second portion and a locking portion for fixing the adjustable tuning apparatus to the slot antenna body; and a coaxial feeder cable, an inner core wire of the cable being electrically connected to one side of the slot through the first portion, and an outer shield of the cable being electrically connected to another side of the slot through the second portion, the outer shield being soldered to the second portion, wherein the adjustable tuning apparatus can slide along the slot to change the operating frequency band of the slot antenna body when the locking portion is released.

8. An adjustable tuning apparatus for adjusting operating frequency band of a slot antenna which includes an antenna body and a coaxial feeder cable, comprising:

a conductive holding portion engaging with the antenna body at one side of an elongated slot defined in the antenna body;

a conductive slide portion in contact with the antenna body at a second side of the slot;

an insulative connecting portion connecting the holding portion with the slide portion; and a locking portion for fixing the adjustable tuning apparatus to the antenna body, wherein an inner core wire of the cable is electrically connected to the antenna body through the holding portion, an outer shield of the cable is electrically connected to the antenna body through the slide portion, the outer shield being soldered to the slide portion, and the adjustable tuning apparatus can slide along the slot to change the operating frequency band of the slot antenna when the locking portion is released.

* * * * *